US007339554B2

(12) United States Patent
Hsu et al.

(10) Patent No.: US 7,339,554 B2
(45) Date of Patent: Mar. 4, 2008

(54) PLASMA DISPLAY PANEL AND ITS DRIVING METHOD

(75) Inventors: Horng-Bin Hsu, Taipei (TW); Yi-I Lu, Taoyuan (TW); Yung-Chan Chou, Sinjhuang (TW)

(73) Assignee: AU Optronics Corporation (TW)

( * ) Notice: Subject to any disclaimer, the term of this patent is extended or adjusted under 35 U.S.C. 154(b) by 562 days.

(21) Appl. No.: 10/861,135

(22) Filed: Jun. 4, 2004

(65) Prior Publication Data

US 2006/0007060 A1 Jan. 12, 2006

(51) Int. Cl.
*G09G 3/28* (2006.01)

(52) U.S. Cl. ..... 345/60; 345/68; 315/169.4

(58) Field of Classification Search ..... 345/60–72; 315/169.4

See application file for complete search history.

(56) References Cited

U.S. PATENT DOCUMENTS 6,465,970 B2 10/2002 Nagakubo et al.
2002/0014847 A1* 2/2002 Nagakubo et al. ..... 315/169.1
2002/0014848 A1 2/2002 Tokunaga

FOREIGN PATENT DOCUMENTS

JP 2001-236037 8/2001

* cited by examiner

*Primary Examiner*—Amr A. Awad
*Assistant Examiner*—Yong Sim
(74) *Attorney, Agent, or Firm*—Duane Morris LLP

(57) ABSTRACT

A method for driving a cell of a plasma display panel in a duration of a frame, in which the frame contains a plurality of subfields. The method comprises setting a selected subfield in the frame of at least one cell of a scanning line to a selected state; setting each one of the subfields preceding the selected subfield to a state opposite the selected state; setting each one of the subfields succeeding the selected subfield in the frame to the same state as a corresponding subfield of a corresponding cell in an adjacent previous scanning line; and driving the one cell by turning the cell into either an ON or OFF condition from the selected subfield throughout the succeeding subfields in the frame based on the selected state of the selected subfield. Another method is to set each one of the subfields succeeding the selected subfield in the frame, based on states of corresponding subfields of corresponding cells in an adjacent previous scanning line and an adjacent next scanning line. Another aspect of the present invention is a plasma display panel driven by the aforementioned methods.

18 Claims, 18 Drawing Sheets

Selective Write Conversion Table

| Gradation Level | Image Data | SF Data | | | | | | | | | | | | | |
|---|---|---|---|---|---|---|---|---|---|---|---|---|---|---|---|
| | | SF14 | SF13 | SF12 | SF11 | SF10 | SF9 | SF8 | SF7 | SF6 | SF5 | SF4 | SF3 | SF2 | SF1 |
| 1 | 0000 | 0 | 0 | 0 | 0 | 0 | 0 | 0 | 0 | 0 | 0 | 0 | 0 | 0 | 0 |
| 2 | 0001 | 0 | 0 | 0 | 0 | 0 | 0 | 0 | 0 | 0 | 0 | 0 | 0 | 0 | 1 |
| 3 | 0010 | 0 | 0 | 0 | 0 | 0 | 0 | 0 | 0 | 0 | 0 | 0 | 0 | 1 | 0 |
| 4 | 0011 | 0 | 0 | 0 | 0 | 0 | 0 | 0 | 0 | 0 | 0 | 0 | 1 | 0 | 0 |
| 5 | 0100 | 0 | 0 | 0 | 0 | 0 | 0 | 0 | 0 | 0 | 0 | 1 | 0 | 0 | 0 |
| 6 | 0101 | 0 | 0 | 0 | 0 | 0 | 0 | 0 | 0 | 0 | 1 | 0 | 0 | 0 | 0 |
| 7 | 0110 | 0 | 0 | 0 | 0 | 0 | 0 | 0 | 0 | 1 | 0 | 0 | 0 | 0 | 0 |
| 8 | 0111 | 0 | 0 | 0 | 0 | 0 | 0 | 0 | 1 | 0 | 0 | 0 | 0 | 0 | 0 |
| 9 | 1000 | 0 | 0 | 0 | 0 | 0 | 0 | 1 | 0 | 0 | 0 | 0 | 0 | 0 | 0 |
| 10 | 1001 | 0 | 0 | 0 | 0 | 0 | 1 | 0 | 0 | 0 | 0 | 0 | 0 | 0 | 0 |
| 11 | 1010 | 0 | 0 | 0 | 0 | 1 | 0 | 0 | 0 | 0 | 0 | 0 | 0 | 0 | 0 |
| 12 | 1011 | 0 | 0 | 0 | 1 | 0 | 0 | 0 | 0 | 0 | 0 | 0 | 0 | 0 | 0 |
| 13 | 1100 | 0 | 0 | 1 | 0 | 0 | 0 | 0 | 0 | 0 | 0 | 0 | 0 | 0 | 0 |
| 14 | 1101 | 0 | 1 | 0 | 0 | 0 | 0 | 0 | 0 | 0 | 0 | 0 | 0 | 0 | 0 |
| 15 | 1110 | 1 | 0 | 0 | 0 | 0 | 0 | 0 | 0 | 0 | 0 | 0 | 0 | 0 | 0 |

FIG. 4A (PRIOR ART)

Selective Write Conversion Table

| Gradation Level | Image Data | SF Data | | | | | | | | | | | | | |
|---|---|---|---|---|---|---|---|---|---|---|---|---|---|---|---|
| | | SF14 | SF13 | SF12 | SF11 | SF10 | SF9 | SF8 | SF7 | SF6 | SF5 | SF4 | SF3 | SF2 | SF1 |
| 1 | 0000 | 0 | 0 | 0 | 0 | 0 | 0 | 0 | 0 | 0 | 0 | 0 | 0 | 0 | 0 |
| 2 | 0001 | 0 | 0 | 0 | 0 | 0 | 0 | 0 | 0 | 0 | 0 | 0 | 0 | 0 | 1 |
| 3 | 0010 | 0 | 0 | 0 | 0 | 0 | 0 | 0 | 0 | 0 | 0 | 0 | 0 | 1 | 1 |
| 4 | 0011 | 0 | 0 | 0 | 0 | 0 | 0 | 0 | 0 | 0 | 0 | 0 | 1 | 1 | 1 |
| 5 | 0100 | 0 | 0 | 0 | 0 | 0 | 0 | 0 | 0 | 0 | 0 | 1 | 1 | 1 | 1 |
| 6 | 0101 | 0 | 0 | 0 | 0 | 0 | 0 | 0 | 0 | 0 | 1 | 1 | 1 | 1 | 1 |
| 7 | 0110 | 0 | 0 | 0 | 0 | 0 | 0 | 0 | 0 | 1 | 1 | 1 | 1 | 1 | 1 |
| 8 | 0111 | 0 | 0 | 0 | 0 | 0 | 0 | 0 | 1 | 1 | 1 | 1 | 1 | 1 | 1 |
| 9 | 1000 | 0 | 0 | 0 | 0 | 0 | 0 | 1 | 1 | 1 | 1 | 1 | 1 | 1 | 1 |
| 10 | 1001 | 0 | 0 | 0 | 0 | 0 | 1 | 1 | 1 | 1 | 1 | 1 | 1 | 1 | 1 |
| 11 | 1010 | 0 | 0 | 0 | 0 | 1 | 1 | 1 | 1 | 1 | 1 | 1 | 1 | 1 | 1 |
| 12 | 1011 | 0 | 0 | 0 | 1 | 1 | 1 | 1 | 1 | 1 | 1 | 1 | 1 | 1 | 1 |
| 13 | 1100 | 0 | 0 | 1 | 1 | 1 | 1 | 1 | 1 | 1 | 1 | 1 | 1 | 1 | 1 |
| 14 | 1101 | 0 | 1 | 1 | 1 | 1 | 1 | 1 | 1 | 1 | 1 | 1 | 1 | 1 | 1 |
| 15 | 1110 | 1 | 1 | 1 | 1 | 1 | 1 | 1 | 1 | 1 | 1 | 1 | 1 | 1 | 1 |

FIG. 4B (PRIOR ART)

Selective Erase Conversion Table

| Gradation Level | Image Data | SF Data | | | | | | | | | | | | | |
|---|---|---|---|---|---|---|---|---|---|---|---|---|---|---|---|
| | | SF1 | SF2 | SF3 | SF4 | SF5 | SF6 | SF7 | SF8 | SF9 | SF10 | SF11 | SF12 | SF13 | SF14 |
| 1 | 0000 | 0 | 0 | 0 | 0 | 0 | 0 | 0 | 0 | 0 | 0 | 0 | 0 | 0 | 0 |
| 2 | 0001 | 0 | 0 | 0 | 0 | 0 | 0 | 0 | 0 | 0 | 0 | 0 | 0 | 0 | 1 |
| 3 | 0010 | 0 | 0 | 0 | 0 | 0 | 0 | 0 | 0 | 0 | 0 | 0 | 0 | 1 | 0 |
| 4 | 0011 | 0 | 0 | 0 | 0 | 0 | 0 | 0 | 0 | 0 | 0 | 0 | 1 | 0 | 0 |
| 5 | 0100 | 0 | 0 | 0 | 0 | 0 | 0 | 0 | 0 | 0 | 0 | 1 | 0 | 0 | 0 |
| 6 | 0101 | 0 | 0 | 0 | 0 | 0 | 0 | 0 | 0 | 0 | 1 | 0 | 0 | 0 | 0 |
| 7 | 0110 | 0 | 0 | 0 | 0 | 0 | 0 | 0 | 0 | 1 | 0 | 0 | 0 | 0 | 0 |
| 8 | 0111 | 0 | 0 | 0 | 0 | 0 | 0 | 0 | 1 | 0 | 0 | 0 | 0 | 0 | 0 |
| 9 | 1000 | 0 | 0 | 0 | 0 | 0 | 0 | 1 | 0 | 0 | 0 | 0 | 0 | 0 | 0 |
| 10 | 1001 | 0 | 0 | 0 | 0 | 0 | 1 | 0 | 0 | 0 | 0 | 0 | 0 | 0 | 0 |
| 11 | 1010 | 0 | 0 | 0 | 0 | 1 | 0 | 0 | 0 | 0 | 0 | 0 | 0 | 0 | 0 |
| 12 | 1011 | 0 | 0 | 0 | 1 | 0 | 0 | 0 | 0 | 0 | 0 | 0 | 0 | 0 | 0 |
| 13 | 1100 | 0 | 0 | 1 | 0 | 0 | 0 | 0 | 0 | 0 | 0 | 0 | 0 | 0 | 0 |
| 14 | 1101 | 0 | 1 | 0 | 0 | 0 | 0 | 0 | 0 | 0 | 0 | 0 | 0 | 0 | 0 |
| 15 | 1110 | 1 | 0 | 0 | 0 | 0 | 0 | 0 | 0 | 0 | 0 | 0 | 0 | 0 | 0 |

FIG. 6A (PRIOR ART)

Selective Erase Conversion Table

| Gradation Level | Image Data | SF Data | | | | | | | | | | | | | |
|---|---|---|---|---|---|---|---|---|---|---|---|---|---|---|---|
| | | SF1 | SF2 | SF3 | SF4 | SF5 | SF6 | SF7 | SF8 | SF9 | SF10 | SF11 | SF12 | SF13 | SF14 |
| 1 | 0000 | 0 | 0 | 0 | 0 | 0 | 0 | 0 | 0 | 0 | 0 | 0 | 0 | 0 | 0 |
| 2 | 0001 | 0 | 0 | 0 | 0 | 0 | 0 | 0 | 0 | 0 | 0 | 0 | 0 | 0 | 1 |
| 3 | 0010 | 0 | 0 | 0 | 0 | 0 | 0 | 0 | 0 | 0 | 0 | 0 | 0 | 1 | 1 |
| 4 | 0011 | 0 | 0 | 0 | 0 | 0 | 0 | 0 | 0 | 0 | 0 | 0 | 1 | 1 | 1 |
| 5 | 0100 | 0 | 0 | 0 | 0 | 0 | 0 | 0 | 0 | 0 | 0 | 1 | 1 | 1 | 1 |
| 6 | 0101 | 0 | 0 | 0 | 0 | 0 | 0 | 0 | 0 | 0 | 1 | 1 | 1 | 1 | 1 |
| 7 | 0110 | 0 | 0 | 0 | 0 | 0 | 0 | 0 | 0 | 1 | 1 | 1 | 1 | 1 | 1 |
| 8 | 0111 | 0 | 0 | 0 | 0 | 0 | 0 | 0 | 1 | 1 | 1 | 1 | 1 | 1 | 1 |
| 9 | 1000 | 0 | 0 | 0 | 0 | 0 | 0 | 1 | 1 | 1 | 1 | 1 | 1 | 1 | 1 |
| 10 | 1001 | 0 | 0 | 0 | 0 | 0 | 1 | 1 | 1 | 1 | 1 | 1 | 1 | 1 | 1 |
| 11 | 1010 | 0 | 0 | 0 | 0 | 1 | 1 | 1 | 1 | 1 | 1 | 1 | 1 | 1 | 1 |
| 12 | 1011 | 0 | 0 | 0 | 1 | 1 | 1 | 1 | 1 | 1 | 1 | 1 | 1 | 1 | 1 |
| 13 | 1100 | 0 | 0 | 1 | 1 | 1 | 1 | 1 | 1 | 1 | 1 | 1 | 1 | 1 | 1 |
| 14 | 1101 | 0 | 1 | 1 | 1 | 1 | 1 | 1 | 1 | 1 | 1 | 1 | 1 | 1 | 1 |
| 15 | 1110 | 1 | 1 | 1 | 1 | 1 | 1 | 1 | 1 | 1 | 1 | 1 | 1 | 1 | 1 |

FIG. 6B (PRIOR ART)

| | SF14 | SF13 | SF12 | SF11 | SF10 | SF9 | SF8 | SF7 | SF6 | SF5 | SF4 | SF3 | SF2 | SF1 | Switching count |
|---|---|---|---|---|---|---|---|---|---|---|---|---|---|---|---|
| (m,k-2)th cell | 0 | 0 | 0 | 0 | 0 | 0 | 1 | 0 | 0 | 0 | 0 | 0 | 0 | 0 | - |
| (m,k-1)th cell | 0 | 0 | 0 | 0 | 1 | 0 | 0 | 0 | 0 | 0 | 0 | 0 | 0 | 0 | 2 |
| (m,k)th cell | 0 | 0 | 0 | 1 | 0 | 0 | 0 | 0 | 0 | 0 | 0 | 0 | 0 | 0 | 2 |
| (m,k+1)th cell | 0 | 0 | 0 | 0 | 1 | 0 | 0 | 0 | 0 | 0 | 0 | 0 | 0 | 0 | 2 |
| (m,k+2)th cell | 0 | 0 | 0 | 0 | 0 | 0 | 0 | 1 | 0 | 0 | 0 | 0 | 0 | 0 | 2 |

FIG. 8A (PRIOR ART)

| | SF14 | SF13 | SF12 | SF11 | SF10 | SF9 | SF8 | SF7 | SF6 | SF5 | SF4 | SF3 | SF2 | SF1 | Switching count |
|---|---|---|---|---|---|---|---|---|---|---|---|---|---|---|---|
| (m,k-2)th cell | 0 | 0 | 0 | 0 | 0 | 0 | 1 | 1 | 1 | 1 | 1 | 1 | 1 | 1 | - |
| (m,k-1)th cell | 0 | 0 | 0 | 0 | 1 | 1 | 1 | 1 | 1 | 1 | 1 | 1 | 1 | 1 | 2 |
| (m,k)th cell | 0 | 0 | 0 | 1 | 1 | 1 | 1 | 1 | 1 | 1 | 1 | 1 | 1 | 1 | 1 |
| (m,k+1)th cell | 0 | 0 | 0 | 0 | 1 | 1 | 1 | 1 | 1 | 1 | 1 | 1 | 1 | 1 | 1 |
| (m,k+2)th cell | 0 | 0 | 0 | 0 | 0 | 0 | 0 | 1 | 1 | 1 | 1 | 1 | 1 | 1 | 3 |

FIG. 8B (PRIOR ART)

| | SF14 | SF13 | SF12 | SF11 | SF10 | SF9 | SF8 | SF7 | SF6 | SF5 | SF4 | SF3 | SF2 | SF1 | Switching count |
|---|---|---|---|---|---|---|---|---|---|---|---|---|---|---|---|
| (m,k-2)th cell | 0 | 0 | 0 | 0 | 0 | 0 | 1 | 0 | 0 | 0 | 0 | 0 | 0 | 0 | - |
| (m,k-1)th cell | 0 | 0 | 0 | 0 | 1 | 0 | 1 | 0 | 0 | 0 | 0 | 0 | 0 | 0 | 1 |
| (m,k)th cell | 0 | 0 | 0 | 1 | 1 | 0 | 1 | 0 | 0 | 0 | 0 | 0 | 0 | 0 | 1 |
| (m,k+1)th cell | 0 | 0 | 0 | 0 | 1 | 0 | 1 | 0 | 0 | 0 | 0 | 0 | 0 | 0 | 1 |
| (m,k+2)th cell | 0 | 0 | 0 | 0 | 0 | 0 | 0 | 1 | 0 | 0 | 0 | 0 | 0 | 0 | 3 |

FIG. 10

| | SF14 | SF13 | SF12 | SF11 | SF10 | SF9 | SF8 | SF7 | SF6 | SF5 | SF4 | SF3 | SF2 | SF1 | Switching count |
|---|---|---|---|---|---|---|---|---|---|---|---|---|---|---|---|
| (m,k-2)th cell | 0 | 0 | 0 | 0 | 0 | 0 | 1 | 0 | 0 | 0 | 0 | 0 | 0 | 0 | - |
| (m,k-1)th cell | 0 | 0 | 0 | 0 | 1 | 0 | 0 | 0 | 0 | 0 | 0 | 0 | 0 | 0 | 2 |
| (m,k)th cell | 0 | 0 | 0 | 1 | 1 | 0 | 0 | 0 | 0 | 0 | 0 | 0 | 0 | 0 | 1 |
| (m,k+1)th cell | 0 | 0 | 0 | 0 | 1 | 0 | 0 | 0 | 0 | 0 | 0 | 0 | 0 | 0 | 1 |
| (m,k+2)th cell | 0 | 0 | 0 | 0 | 0 | 0 | 0 | 1 | 0 | 0 | 0 | 0 | 0 | 0 | 2 |

FIG. 13

| | SF14 | SF13 | SF12 | SF11 | SF10 | SF9 | SF8 | SF7 | SF6 | SF5 | SF4 | SF3 | SF2 | SF1 | Switching count |
|---|---|---|---|---|---|---|---|---|---|---|---|---|---|---|---|
| (m,k-2)th cell | 0 | 0 | 0 | 0 | 0 | 0 | 1 | 1 | 0 | 0 | 0 | 0 | 0 | 0 | - |
| (m,k-1)th cell | 0 | 0 | 0 | 0 | 1 | 0 | 1 | 1 | 0 | 0 | 0 | 0 | 0 | 0 | 1 |
| (m,k)th cell | 0 | 0 | 0 | 1 | 1 | 0 | 1 | 1 | 0 | 0 | 0 | 0 | 0 | 0 | 1 |
| (m,k+1)th cell | 0 | 0 | 0 | 0 | 1 | 0 | 1 | 1 | 0 | 0 | 0 | 0 | 0 | 0 | 1 |
| (m,k+2)th cell | 0 | 0 | 0 | 0 | 0 | 0 | 0 | 1 | 0 | 0 | 0 | 0 | 0 | 0 | 2 |

FIG. 15

PLASMA DISPLAY PANEL AND ITS DRIVING METHOD

FIELD OF THE INVENTION

The present invention relates to a plasma display panel (PDP), and a method for driving a plasma display panel.

BACKGROUND

Because of the great demand for a thin display, the technology of a plasma display panel has been developed and substantially advanced recently. A plasma display panel comprises a plurality of data electrodes and a plurality of scanning lines arranged perpendicular to the data electrodes to form a plurality of cells at the intersections. The cells are electronically driven to emit light, according to video signals corresponding to the predetermined gray level of the cells.

In FIG. 1, a frame of the video signal is divided into four (4) successive subfields SF1-SF4. Each subfield is further apportioned into successive periods of reset (Rc), address (Wc), sustain (Ic) and erase (E). In the reset period (Rc) all cells are set to an initial state, either ON or OFF state. In the address period (Wc) each cell is set to either ON or OFF according to the corresponding image data. In the sustain period (Ic), the ON or OFF state of each cell is maintained. In the erase period (E), the cells in the ON state are switched to OFF. The gray level of the emitted light of each cell is determined by the number and the duration of subfields set to ON in the frame. The duration of the sustain period of a subfield is proportional to the brightness generated from that specific subfield. For example, when a frame has four subfields, the duration of the sustain period of which is set to 1:2:4:8, the brightness generated from the respective subfields is also weighted 1:2:4:8. As a result, sixteen (16) gray levels can be presented in the frame by each cell. Likewise, for a frame with eight (8) subfields, 256 gray levels can be displayed. Thus, a PDP driven by a video signal having N subfields per frame is capable of displaying a video image with $2^N$ gray levels.

A disadvantage of the aforementioned method is that each cell is reset at the beginning of each subfield and addressed in the following address period of the same subfield, causing high numbers of switching operations and consequently resulting in high switching loss and heat generation of the addressing ICs. The addressing ICs are high speed digital integrated circuits performing addressing operations. Another disadvantage is that a display of dynamic false contour occurs while displaying a moving image.

In FIG. 2, a reset period (Rc) exists only at a beginning of a frame, and an erase period exists only at an end of a frame. Since there is no reset or erase period between subfields in a frame, once a cell is addressed, i.e., set to 1, and switched ON in the selective-write mode, or alternatively switched OFF in the selective-erase mode, it will remain in the same state throughout the frame. Therefore, each cell is addressed at most once in one frame and the switching loss and heat generation of addressing ICs is reduced. However, additional reduction in the switching and switching loss is desired.

SUMMARY OF THE INVENTION

A method for driving a cell of a plasma display panel in a duration of a frame, in which the frame contains a plurality of subfields. The method comprises setting a selected subfield in the frame of at least one cell of a scanning line to a selected state; setting each one of the subfields preceding the selected subfield to a state opposite the selected state; setting each one of the subfields succeeding the selected subfield in the frame to the same state as a corresponding subfield of a corresponding cell in an adjacent previous scanning line; and driving the one cell by turning the cell into either an ON or OFF condition from the selected subfield throughout the succeeding subfields in the frame based on the selected state of the selected subfield. Another method is to set each one of the subfields succeeding the selected subfield in the frame, based on states of corresponding subfields of corresponding cells in an adjacent previous scanning line and an adjacent next scanning line. Another aspect of the present invention is a plasma display panel driven by the aforementioned methods.

BRIEF DESCRIPTION OF THE DRAWINGS

A more complete understanding of the present invention can be obtained by reference to the detailed description of embodiments in conjunction with the accompanying drawings, in which:

FIGS. 4A and 4B illustrate a conventional data conversion table for a selective write mode;

FIGS. 6A and 6B illustrate a conventional data conversion table for a selective erase mode;

FIGS. 8A and 8B illustrate conventional SF data tables respectively converted by conventional selective write conversion tables shown in FIGS. 4A and 4B;

FIG. 10 illustrates a SF data table converted by the method shown in FIG. 9;

FIG. 13 illustrates a SF data table converted by the method shown in FIG. 12;

FIG. 15 illustrates a SF data table converted by the method shown in FIG. 14.

DETAILED DESCRIPTION

Figure 3:
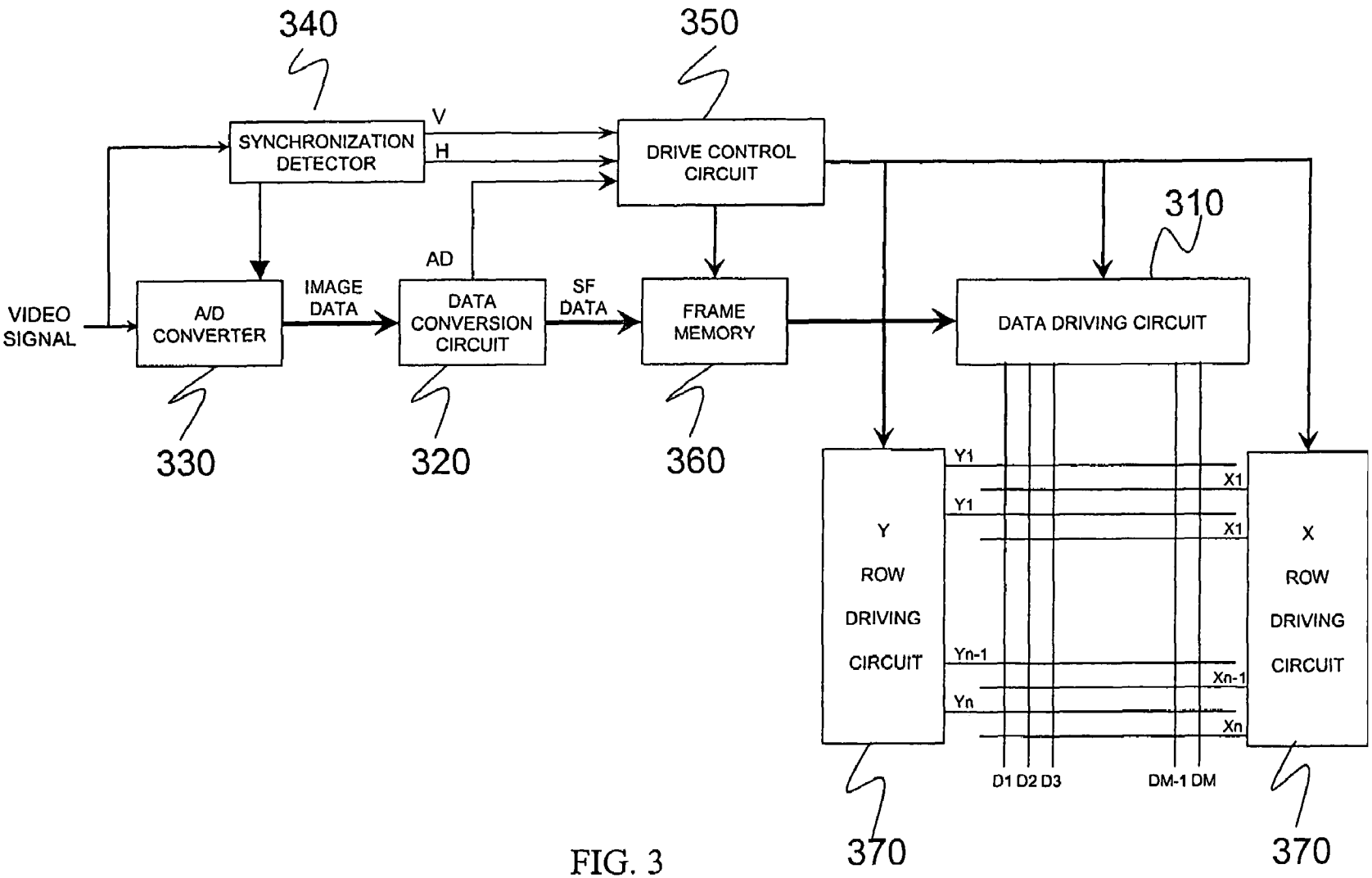
FIG. 3 illustrates a plasma display panel driven according to an exemplary embodiment of the invention.

FIG. 3 illustrates an exemplary embodiment of the structure of a plasma display panel (PDP). The PDP comprises a plurality of data electrodes D1 . . . DM, and a plurality of scanning lines arranged perpendicular to the data electrodes D1 . . . DM. Each of the scanning lines contains a sustain electrode from X1 . . . Xn and a corresponding scan electrode from Y1 . . . Yn. Each intersection of the data electrodes D1 . . . DM and the scanning lines forms a cell in which gas discharge occurs to emit light. A cell is a sub-pixel emitting red, green, or blue light.

Figure 1:
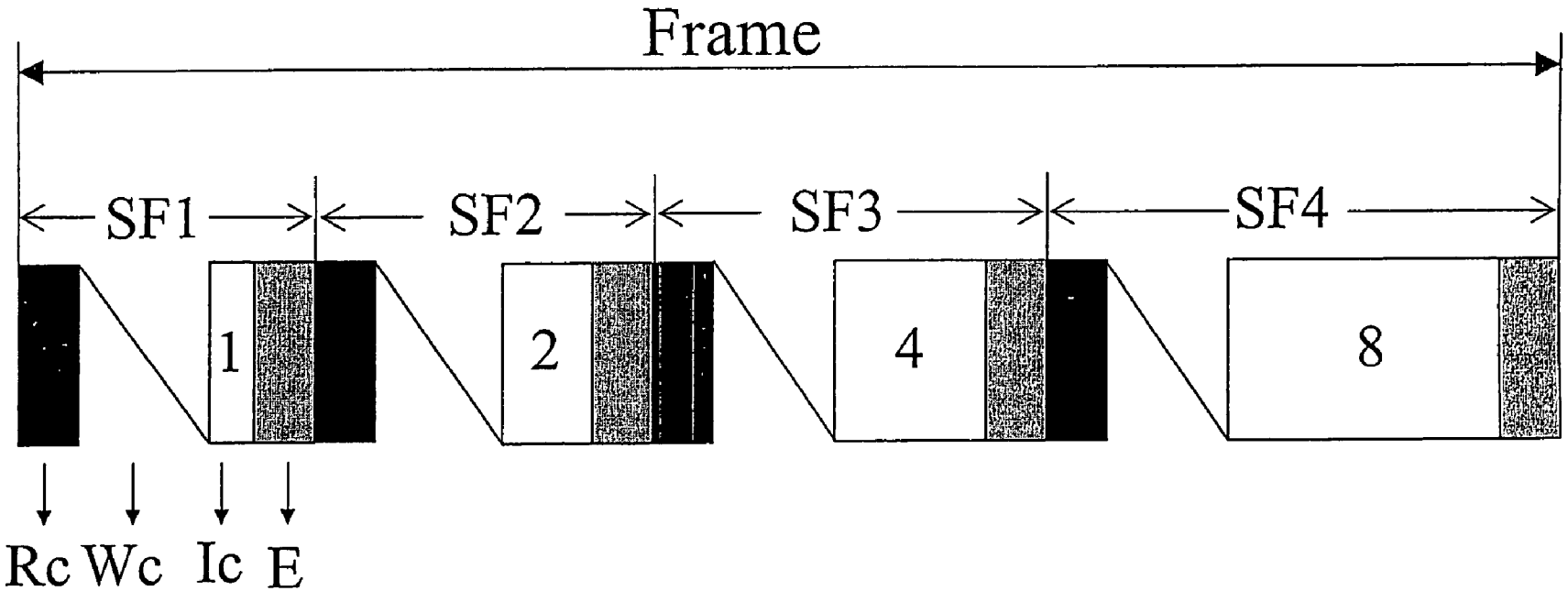
FIG. 1 (PRIOR ART)
FIG. 1 is a diagram of a conventional frame structure with subfields.
Figure 2:
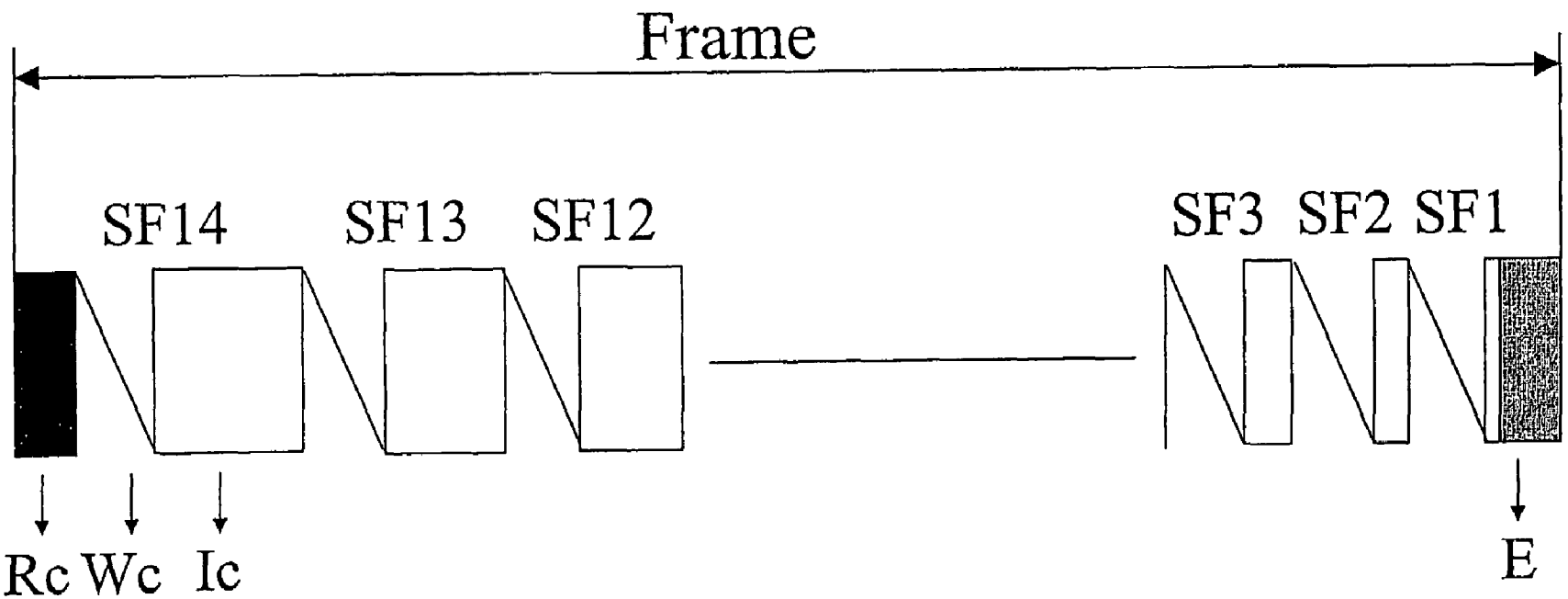
FIG. 2 (PRIOR ART)
FIG. 2 is a diagram of a frame structure for a selective write mode applying a CLEAR driving method.

The cells are driven by a data driving circuit 310 to discharge and emit light to a specific gray level based on the SF data of the cells, which are converted from the image data by a data conversion circuit 320. Other components such as A/D converter 330, synchronization detector 340, drive control circuit 350, frame memory 360 and scanning driving circuit 370 (X and Y row driving circuits), can be conventional to ordinary people in the art. In this example, a CLEAR (High-Contrast, Low Energy Address and Reduction of False Contour Sequence) driving method is employed. With the CLEAR driving method in a selective write mode, as shown in FIG. 2, a frame is divided into a reset period Rc in the beginning of the frame, 14 subfields SF14 . . . SF1, and an erase period E in the end of the frame. Each subfield has an address period Wc followed by a sustain period Ic. In a selective write mode, the cells are reset to an OFF state in the beginning of the frame. The cells are then scanned from subfield 14 to subfield 1 sequentially. For each subfield scan, the cells are scanned, for example, from the first scanning line (X1, Y1) to the last scanning line (Xn, Yn) and then this process is repeated for the next subfield scan. The cells are turned to an ON state at a respective selected subfield and remain in the ON state throughout the rest of the frame. The cells are then turned to an OFF state in the end of the frame during the erase period.

The image data of cells for the period of a frame are converted into SF data in a data conversion circuit 320 and then stored in the frame memory 360. In order to better understand the operation of data conversion circuit 320, it is helpful to first review conventional selective write and selective erase conversions. As shown in FIGS. 4A and 4B, a selective write conversion table is used to convert the image data, such as from 0000 to 1110, into the SF data. The SF data contain 14 digits of a value zero (0) or one (1) which respectively represent the state of 14 subfields in a frame to reflect the gray level of an image datum. In general, the value zero (0) indicates that the state of a cell is OFF at a specific subfield. The value one (1) indicates that the state of a cell is ON at a specific subfield. With the CLEAR driving method, a cell is turned to an ON state when a first value one (1) is scanned at a specific subfield and remains at the ON state throughout the rest of the frame. The subfield of the first value one (1) is referred to herein as the "selected subfield". As a result, the SF value for subfields succeeding the selected subfield does not affect the ON or OFF state of the cell. As a result, in FIG. 4A, the value zero (0) is used to fill all subfields succeeding the selected subfield of the frame. For example, the image data 1010 as a gray level 11 is converted into 00001000000000. In FIG. 4B, the value one (1) is used to fill all subfields succeeding the selected subfield. For example, the image data 1010 as a gray level 11 is converted into 00001111111111.

Figure 5:
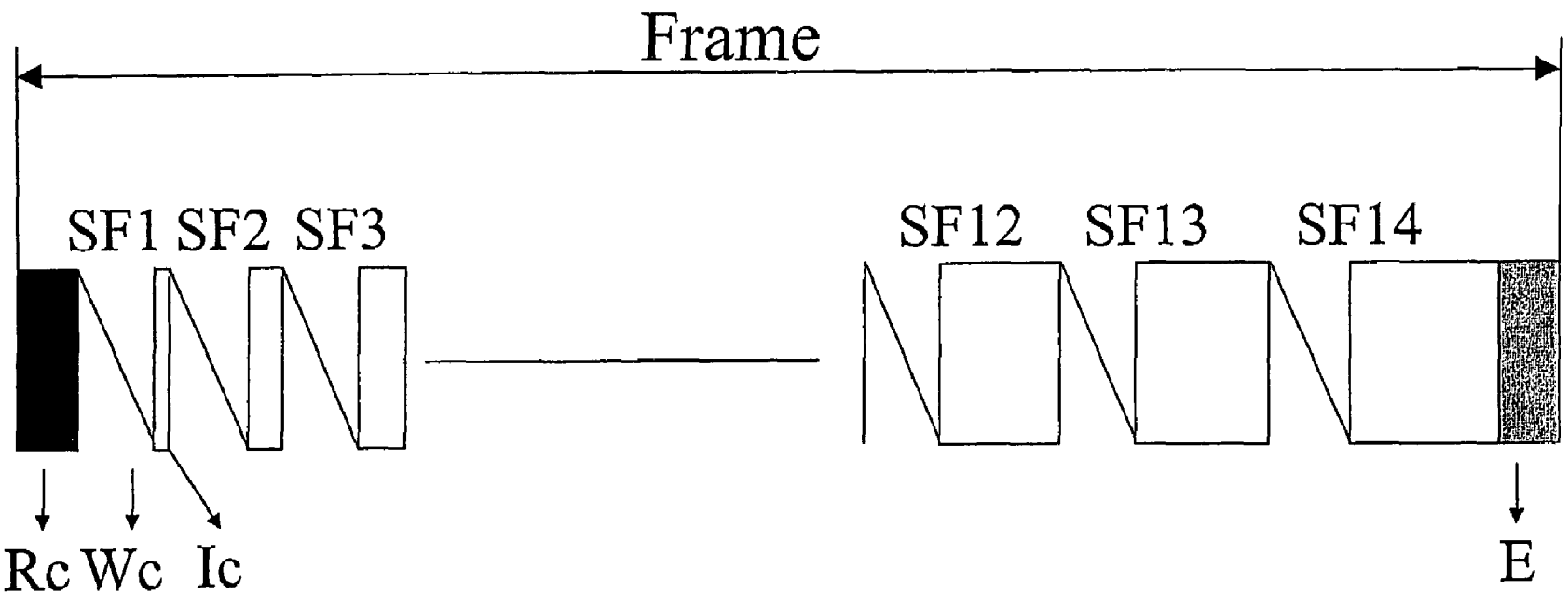
FIG. 5 is a diagram of a conventional frame structure for a selective erase mode applying a CLEAR driving method.

FIG. 5 shows a frame structure with the CLEAR driving method in a selective erase mode. A frame is divided into a reset period Rc in the beginning of the frame, 14 subfields arranged in the order from SF1 to SF14, and an erase period E in the end of the frame. Each subfield has an address period Wc followed by a sustain period Ic. In a selective erase mode, the cells are reset to an ON state in the beginning of the frame. The cells are then scanned from subfield 14 to subfield 1 sequentially. For each subfield scan, the cells are scanned, for example, from the first scanning line (X1, Y1) to the last scanning line (Xn, Yn) and then this procedure is repeated for the next subfield scan. Each respective cell is turned to an OFF state at a respective selected subfield and remains in the OFF state throughout the rest of the frame. The cells are then turned to an OFF state in the end of the frame during the erase period.

The image data of cells for the period of a frame are converted into SF data in a data conversion circuit 320 and then stored in the frame memory 360. As shown in FIG. 6A and 6B, a selective erase conversion table is used to convert the image data, such as from 0000 to 1110, into the SF data. Note that in FIGS. 6A and 6B, the subfields from left to right are SF1-SF14, which is the opposite of the order of the subfields used in the selective write mode shown in FIGS. 4A and 4B. The SF data contain 14 digits of a value zero (0) or one (1) which respectively represent the state of 14 subfields in a frame to reflect the gray level of an image datum. In general, the value zero (0) indicates that the state of a cell is ON at a specific subfield. The value one (1) indicates that the state of a cell is OFF at a specific subfield. With the CLEAR driving method, a cell is turned to an OFF state when a first value one (1) is scanned at a specific subfield and remains at the OFF state throughout the rest of the frame. The subfield of the first value one (1) is the selected subfield of the frame. As a result, the SF value for subfields succeeding the selected subfield does not affect the ON or OFF state of the cell. As a result, in FIG. 6A, the value zero (0) is used to fill all subfields succeeding the selected subfield. For example, the image data 1010 as a gray level 11 is converted into 00001000000000. In FIG. 6B, the value one (1) is used to fill all subfields succeeding the selected subfield. For example, the image data 1010 as a gray level 11 is converted into 00001111111111.

Figure 7:
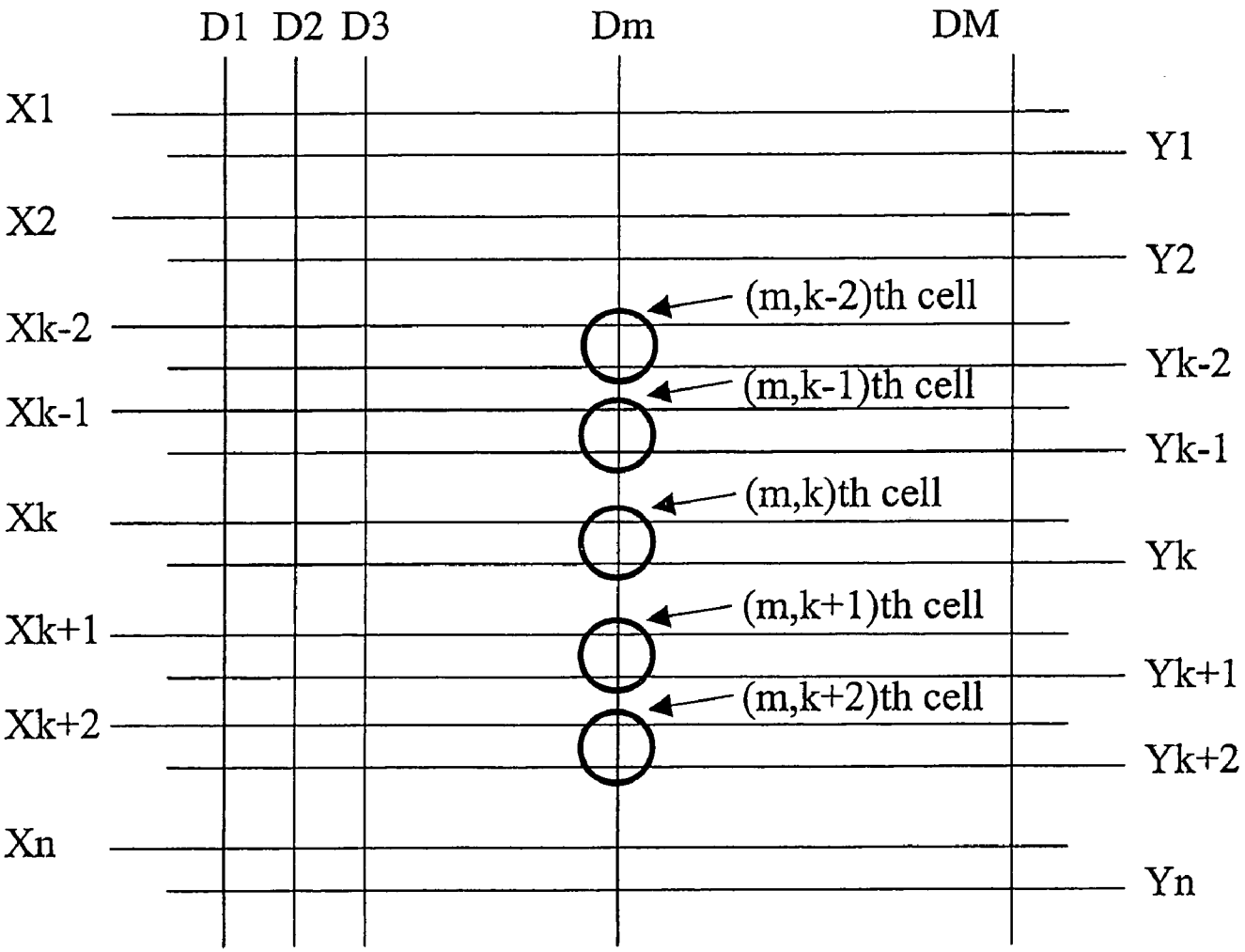
FIG. 7 illustrates an exemplary embodiment of part of the plasma display panel shown in FIG. 3.

In FIG. 7, five (5) cells in a PDP are taken as an example—cell (m, k−2), cell (m, k−1), cell (m, k), cell (m, k+1), and (m, 1+2) cell—respectively formed at the intersection of the data electrode Dm and the scanning lines ($X_{k-2}$, $Y_{k-2}$), ($X_{k-1}$, $Y_{k-1}$), ($X_k$, $Y_k$), ($X_{k+1}$, $Y_{k+1}$), ($X_{k+2}$, $Y_{k+2}$). FIG. 8A shows a set of SF data for cell (m, k−2), cell (m, k−1), cell (m, k), cell (m, k+1), and cell (m, k+2) converted by a prior art method shown in FIG. 4A. Taking the scan of the subfield 10 as an example, when the PDP scans from the scanning line ($X_{k-2}$, $Y_{k-2}$) to the scanning line ($X_{k+2}$, $Y_{k+2}$), the value of the data electrode Dm changes from 0 to 1, from 1 to 0, from 0 to 1, and from 1 to 0. There are four SF data switching events. FIG. 8B shows another set of SF data for cell (m, k−2), cell (m, k−1), cell (m, k), cell (m, k+1), and cell (m, k+2) converted by a prior art method shown in FIG. 4B. Taking the scan of the subfield 10 as an example, when the PDP scans from the scanning line ($X_{k-2}$, $Y_{k-2}$) to the scanning line ($X_{k+2}$, $Y_{k+2}$), the value of the data electrode Dm changes from 0 to 1, and from 1 to 0. There are two SF data switching events.

The following method sets the SF data of a subfield succeeding the selected subfield in a frame of a cell based on the SF data of a corresponding subfield of a corresponding cell in an adjacent previous scanning line and/or an adjacent next scanning line. As a result, the number of SF data switching operations by the data driving IC is decreased and the energy consumption is reduced.

EXAMPLE I

Figure 9:
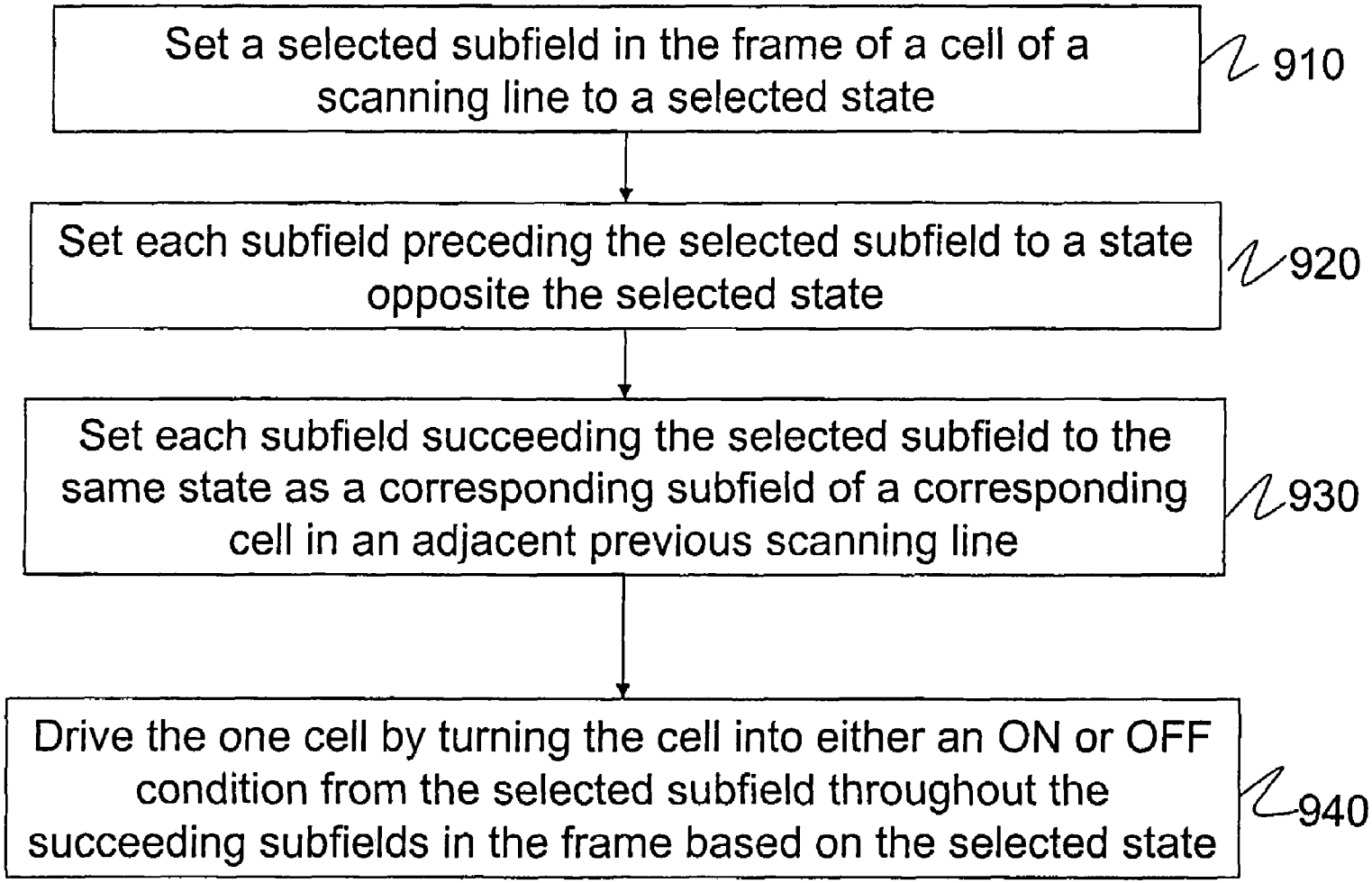
FIG. 9 is a flow chart diagram of an exemplary method to convert a SF data table.

FIG. 9 shows an exemplary embodiment for driving cells of a PDP in a frame which is divided into 14 subfields. At step 910 a selected subfield in the frame of each cell is set to a selected state according to the corresponding image data. At step 920, each one of the subfields preceding the selected subfield is set to a state opposite the selected state. At step 930, each one of the subfields succeeding the selected subfield is set to the same state as a corresponding subfield of a corresponding cell in an adjacent previous scanning line. At step 940, the one cell is driven by turning the cell into either an ON or OFF condition beginning with the selected subfield and continuing throughout the succeeding subfields in the frame based on the selected state of the selected subfield.

FIG. 10 is an example of a SF data table converted from a set of image data (1000, 1010, 1011, 1010, 0111) for five cells on the intersection of the data line Dm and five adjacent scanning lines from k−2 to k+2 by following the process flow shown in FIG. 9. At step 910, according to the gray level of the image data for the cells, the selected subfield [e.g., SF8 for cell (m, k−2), SF10 for cell (m, k−1), SF11 for cell (m, k), SF10 for cell (m, k+1), SF7 for cell (m, k+2),] is set to the value one (1). At step 920, each one of the subfields preceding the selected subfield is set to the value zero (0), which is opposite to the value of the selected subfield.

At step 930, the subfields SF7-SF1 succeeding the selected subfield SF8 in the frame of cell (m, k−2) are all set to the value zero (0) as they are respectively copied from the corresponding subfields of a corresponding cell of an adjacent previous scanning line. The subfields SF9-SF1 succeeding the selected subfield SF10 in the frame of cell (m, k−1) are set to be the same value as the corresponding subfields of cell (m, k−2). The subfields SF10-SF1 succeeding the selected subfield SF11 in the frame of cell (m, k) are set to be the same value as the corresponding subfields of cell (m, k−1). The subfields SF9-SF1 succeeding the selected subfield SF10 in the frame of cell (m, k+1) are set to be the same value as the corresponding subfields of cell (m, k). The subfields SF6-SF1 succeeding the selected subfield SF7 in the frame of cell (m, k+2) are set to be the same value as the corresponding subfields of cell (m, k+1). At step 940, the SF data is then used to drive the PDP cells by turning on a specific cell from the selected subfield throughout the frame in a selective write mode.

The data driving IC has to switch SF data values on the data electrode Dm twice while scanning subfield 11 from the scanning line $(X_{k-2}, Y_{k-2})$ to the scanning line $(X_{k+2}, Y_{k+2})$. Likewise, the data driving IC has to switch SF data values twice while scanning subfield 10, to switch once while scanning subfield 8, and to switch once while scanning subfield 7. In total, the data driving IC has to switch SF data value on the data electrode Dm six (6) times, which is two times less than the prior art method shown in FIG. 8A, while scanning from the subfield 14 to the subfield 1 and from the scanning line $(X_{k-2}, Y_{k-2})$ to the scanning line $(X_{k+2}, Y_{k+2})$.

EXAMPLE II

Figure 11:
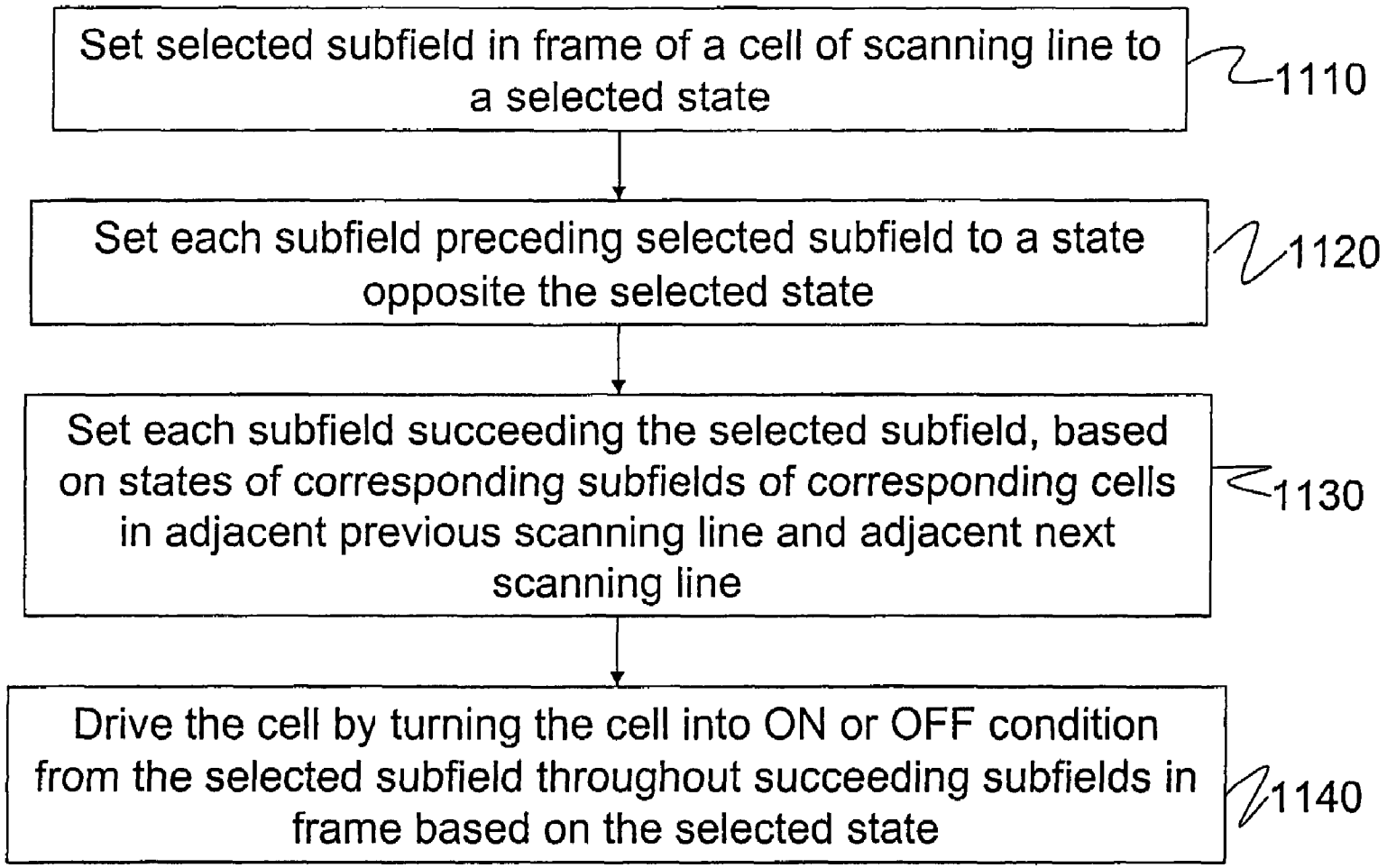
FIG. 11 is a flow chart diagram of another exemplary method to convert a SF data table.

As shown in FIG. 11, an exemplary embodiment of the invented method for driving cells of a PDP in a frame which are further divided into 14 subfields comprises four steps. At step 1110, a selected subfield in the frame of each cell is set to a selected state according to the image data. At step 1120, each one of the subfields preceding the selected subfield is set to a state opposite the selected state. At step 1130, each one of the subfields succeeding the selected subfield is set based on states of corresponding subfields of corresponding cells in an adjacent previous scanning line and an adjacent next scanning line. At step 1140, the one cell is driven by turning the cell into either an ON or OFF condition from the selected subfield throughout the succeeding subfields in the frame based on the selected state of the selected subfield.

One embodiment of the driving method is to set each one of the subfields succeeding the selected subfield to a result of an AND operation between states of corresponding subfields of corresponding cells in an adjacent previous scanning line and an adjacent next scanning line. Thus, for the subfield following the selected subfield of a given cell, if the corresponding subfield values in the adjacent cells above and below the given cell both have the value "1", then the value "1" is also used for the given cell. This avoids switching the value back and forth.

Another embodiment is to set each one of the subfields succeeding the selected subfield to a result of an OR operation between states of corresponding subfields of corresponding cells in an adjacent previous scanning line and an adjacent next scanning line. Skilled artisans will appreciate various ways to set each one of the subfields succeeding the selected subfield, based on states of corresponding subfields of corresponding cells in an adjacent previous scanning line and an adjacent next scanning line, such as other Boolean operations.

Figure 12:
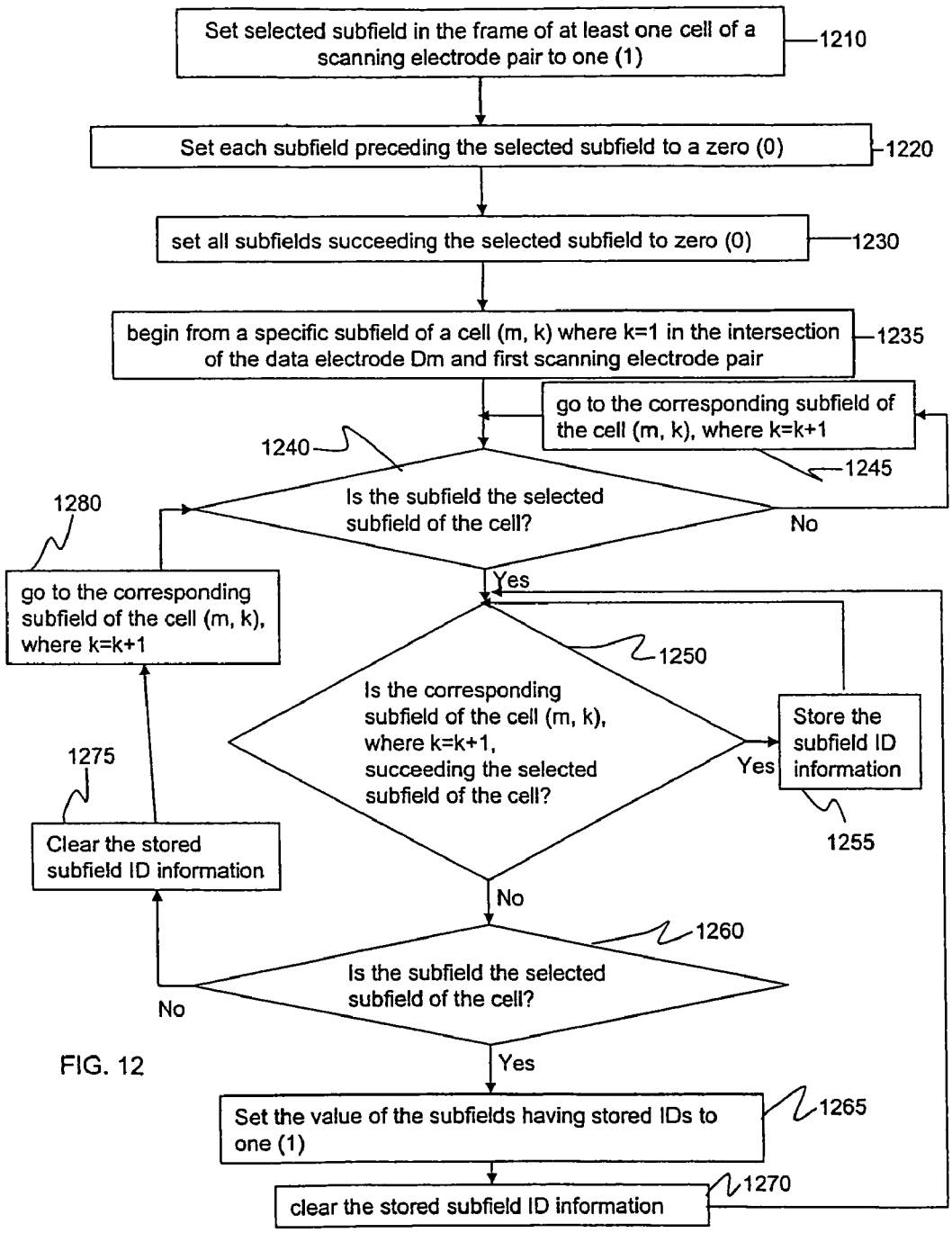
FIG. 12 is a flow chart diagram of an exemplary AND operation to convert a SF data table.

FIG. 12 illustrates an embodiment of steps which can convert, according to the AND operation, the image data for the screen cells into the SF data used to drive the screen cells by the data driving circuit. Working from a set of initial SF data in FIG. 8A, at step 1210, according to the gray level of the image data for the cells, the selected subfield which is the SF8 for cell (m, k−2), the SF10 for cell (m, k−1), the SF11 for cell (m, k), the SF10 for cell (m, k+1), and SF7 for cell (m, k+2), is set to the value one (1). At step 1220, each one of the subfields preceding the selected subfield is set to the value zero (0), which is opposite to the value of the selected subfield. At step 1230, the subfields succeeding the selected subfield in the frame of the cells are all set to the value zero (0).

At step 1235, the AND operation begins from subfield 10 of cell (m, k−2) which is the first scanning line in the example. At step 1240, subfield 10 is not the selected subfield of cell (m, k−2). At step 1245, the working subfield moves down to subfield 10 of cell (m, k−1). Going back to the step 1240, subfield 10 is the selected subfield of cell (m, k−1). At step 1250, subfield 10 of cell (m, k) is checked and determined to be the subfield succeeding the selected subfield, subfield 11 of cell (m, k). At step 1255, the ID of subfield 10 of cell (m, k) is stored. Going back to step 1250, subfield 10 of cell (m, k+1) is not succeeding the selected subfield, subfield 10 of cell (m, k). At step 1260, subfield 10 is the selected subfield of cell (m, k+1). At step 1265, subfield 10 of cell (m, k), the ID stored subfield, is set to the value one (1). At step 1270, the stored subfield ID information is cleared. Going back to step 1250, subfield 10 of cell (m, k+2) is not succeeding the selected subfield, subfield 7 of cell (m, k+2). At step 1260, subfield 10 of cell (m, k+2) is not the selected subfield of the cell. At step 1275, the stored subfield information is cleared if there is any. At step 1280, the process ends because cell (m, k+2) is on the last scanning line in this example. Every subfield is checked and its value is converted according to the process from step 1235. FIG. 13 shows a final converted set of the SF data which are then used to drive the PDP cells by turning on a specific cell from the selected subfield throughout the frame in a selective write mode.

By using the SF data as shown in FIG. 13 to drive the screen cells, the total times of switching data signals on the data electrode Dm is six (6) which is less than eight (8) times shown in FIG. 8A from the scanning line $(X_{k-2}, Y_{k-2})$ to the scanning line $(X_{k+2}, Y_{k+2})$.

Figure 14:
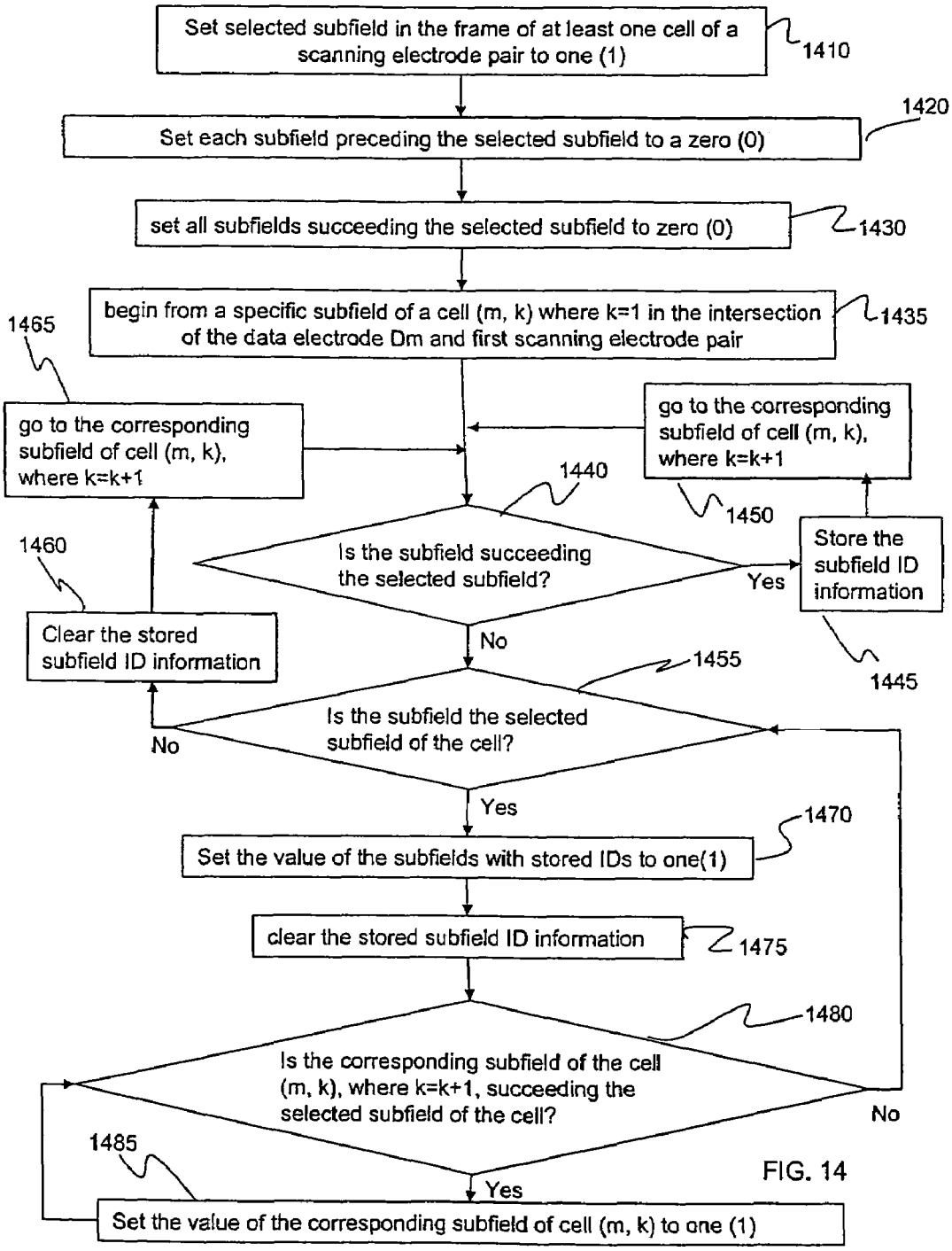
FIG. 14 is a flow chart diagram of an exemplary OR operation to convert a SF data table.

FIG. 14 illustrates an embodiment of steps which can convert, according to the OR operation, the image data for the screen cells into the SF data used to drive the screen cells by the address driver. Working from a set of initial SF data in FIG. 8A, at step 1410, according to the gray level of the image data for the cells, the selected subfield which is SF8 for cell (m, k−2), SF10 for cell (m, k−1), SF11 for cell (m, k), SF10 for cell (m, k+1), and SF7 for cell (m, k+2), is set to the value one (1). At step 1420, each one of the subfields preceding the selected subfield is set to the value zero (0), which is opposite to the value of the selected subfield. At step 1430, the subfields succeeding the selected subfield in the frame of the cells are all set to the value zero (0).

At step 1435, the OR operation begins from a specific subfield and goes on to other subfields. For each subfield, the OR operation commences from the first scanning line. The subfield 8 of cell (m, k−2) is used as an example. At step 1440, subfield 8 is not succeeding the selected subfield of the cell. Going to step 1455, subfield 8 is the selected subfield of cell (m, k−2). At step 1470, the value of the subfield with stored ID is set to the value one (1), if there is any subfield with stored ID. Because there is no ID stored subfield so far in this example, this step is skipped. At step 1475, the stored subfield ID information is cleared, if there is any stored subfield ID information. Because there is no stored subfield ID information yet in this example, this step is skipped. At step 1480, subfield 8 of cell (m, k−1) is succeeding the selected subfield, SF 10, of the cell. At step 1485, the value of subfield 8 of cell (m, k−1) is set to one (1). Going back to step 1480, subfield 8 of cell (m, k) is succeeding the selected subfield, SF 11, of the cell. At step 1485, the subfield of cell (m, k) is set to value one (1). Going back to step 1480, subfield 8 of cell (m, k+1) is succeeding the selected subfield, SF 10, of the cell. At step 1485, subfield 8 of cell (m, k+1) is set to the value one (1). Going back to step 1480, subfield 8 of cell (m, k+2) is not succeeding the selected subfield, SF 7, of the cell. At step 1455, subfield 8 is not the selected subfield of (m, k+2) cell. At step 1460, the stored subfield ID information is cleared, if there is any stored subfield ID information. Because there is no stored subfield ID information so far in this example, this step is skipped. At step 1465, the conversion process ends because the scanning line k+2 is the last one in this example.

Taking subfield 7 as another example, at step 1435, the OR operation commences from the first scanning line, (m, k−2) in this example. At step 1440, subfield 7 is succeeding the selected subfield, SF 8, of (m, k−2) cell. Going to step 1445, the ID information regarding subfield 7 of cell (m, k−2) is stored. At step 1450, subfield 7 of cell (m, k−1) becomes the working target to be examined. Back to step 1440, subfield 7 is succeeding the selected subfield, SF 10, of (m, k−1) cell. At step 1445, the ID information regarding subfield 7 of cell (m, k−1) is stored. At step 1450, subfield 7 of cell (m, k) becomes the working target to be examined. Going back to step 1440, subfield 7 is succeeding the selected subfield, SF 11, of (m, k) cell. Going to step 1445, the ID information regarding subfield 7 of cell (m, k) is stored. At step 1450, subfield 7 of cell (m, k+1) becomes the working target to be examined. Back to step 1440, subfield 7 is succeeding the selected subfield, SF 10, of (m, k+1) cell. At step 1445, the ID information regarding subfield 7 of cell (m, k+1) is stored. At step 1450, subfield 7 of cell (m, k+2) becomes the working target to be examined. Going back to step 1440, subfield 7 is not succeeding the selected subfield, SF 7, of cell (m, k+2). At step 1455, subfield 7 is the selected subfield of cell (m, k+2). At step 1470, the values of subfields with stored IDs, subfield 7 of cell (m, k−2), cell (m, k−1), cell (m, k), and cell (m, k+1), are set to one (1). At step 1475, stored subfield ID information is cleared. At step 1480, the conversion process ends because the scanning line k+2 is the last one in this example.

Every subfield is checked and its value is converted according to the process from step 1435. FIG. 15 shows a final converted set of the SF data which are then used to drive the PDP cells by turning on a specific cell from the selected subfield throughout the frame in a selective write mode.

By using the SF data as shown in FIG. 15 to drive the screen cells, the total number of data signal switching events on the data electrode Dm is five (5), which is less than eight (8) times shown in FIG. 8A from the scanning line ($X_{k-2}$, $Y_{k-2}$) to the scanning line ($X_{k+2}$, $Y_{k+2}$).

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

What is claimed is:

1. A method for driving a cell of a plasma display panel having a plurality of scanning lines in a duration of a frame, in which the frame contains a plurality of subfields, said method comprising:

setting a selected subfield in the frame of at least one cell of one of the plurality of scanning lines to a selected state;

setting each one of the subfields preceding the selected subfield to a state opposite the selected state;

initially setting each one of the subfields succeeding the selected subfield in the frame to the state opposite the selected state; and then for each of the plurality of scanning lines following the first one of the plurality of scanning lines, setting each one of the subfields succeeding the selected subfield in the frame to the same state as a corresponding subfield of a corresponding cell in an adjacent previous scanning line; and driving the one cell by turning the cell into either an ON or OFF condition from the selected subfield throughout the succeeding subfields in the frame based on the selected state of the selected subfield.

2. The method of claim 1, wherein a value of the selected subfield in the frame is set to one and each of the preceding subfields is set to zero.

3. The method of claim 2, wherein the cell is turned off at the beginning of the frame and is turned on from the selected subfield throughout the succeeding subfields in the frame when a selective write mode is chosen.

4. The method of claim 2, wherein the cell is turned on at the beginning of the frame and is turned off from the selected subfield throughout the succeeding subfields in the frame when a selective erase mode is chosen.

5. A method for driving a cell of a plasma display panel in a duration of a frame, in which the frame contains a plurality of subfields, said method comprising:

setting a selected subfield in the frame of at least one cell of a scanning line to a selected state;

setting each one of the subfields preceding the selected subfield to a state opposite the selected state; and initially setting each one of the subfields succeeding the selected subfield in the frame to the state opposite the selected state; and then for each of the plurality of scanning lines following a first one of the scanning lines and preceding a last one of the plurality of scanning lines, setting each one of the subfields succeeding the selected subfield in the frame, based on states of corresponding subfields of corresponding cells in an adjacent previous scanning line and an adjacent next scanning line;

driving the one cell by turning the cell into either an ON or OFF condition from the selected subfield throughout the succeeding subfields in the frame based on the selected state of the selected subfield.

6. The method of claim 5, wherein each one of the successive subfields in the frame of the one cell is set to a result of an AND operation between states of corresponding subfields of corresponding cells in an adjacent previous scanning line and an adjacent next scanning line.

7. The method of claim 5, wherein each of the successive subfields in the frame of the one cell is set to a result of an OR operation between states of corresponding subfields of corresponding cells in an adjacent previous scanning line and an adjacent next scanning line.

8. The method of claim 5, wherein a value of the selected subfield in the frame of the one cell is set to one, and the value of each the preceding subfields is set to zero.

9. The method of claim 8, wherein the one cell is turned off at the beginning of the frame and is turned on from the selected subfield throughout the succeeding subfields in the frame when a selective write mode is chosen.

10. The method of claim 8, wherein the one cell is turned on at the beginning of the frame and is turned off from the selected subfield throughout the succeeding subfields in the frame when a selective erase mode is chosen.

11. A plasma display panel comprising:

a plurality of data electrodes;

a data driving circuit;

a plurality of scanning lines arranged perpendicular to the data electrodes to form a plurality of cells at intersections thereof, each of the scanning lines containing a sustain electrode and a scan electrode;

a scanning driving circuit;

a data conversion circuit to convert an image datum of the cell for the data driving circuit to drive the cell, the image datum containing a plurality of subfields with one selected subfield;

wherein a selected subfield in the frame of at least one cell of one of the plurality of scanning lines is set to a selected state.

each one of the subfields preceding the selected subfield in the frame are initially set to the state opposite the selected state; and then for each of the plurality of scanning lines following the first one of the plurality of scanning lines, the data conversion circuit converts the subfields succeeding the selected subfield of the image datum of the cell to the same state as a corresponding subfield of an image datum of a corresponding cell on an adjacent previous scanning line.

12. A plasma display panel comprising:

a plurality of data electrodes;

a data driving circuit;

a plurality of scanning lines arranged perpendicular to the data electrodes to form a plurality of cells at intersections thereof, each of the scanning lines containing a sustain electrode and a scan electrode;

a scanning driving circuit;

a data conversion circuit to convert an image datum of the cell for the data driving circuit to drive the cell, the image datum containing a plurality of subfields with one selected subfield;

wherein the data conversion circuit sets the selected subfield in the frame of at least one cell of one of the plurality of scanning lines to a selected state.

the data conversion circuit initially sets each one of the subfields succeeding the selected subfield in the frame to the state opposite the selected state; and then for each of the plurality of scanning lines following a first one of the scanning lines and preceding a last one of the plurality of scanning lines, the data conversion circuit converts the subfield succeeding the selected subfield of the image datum of the cell based on states of corresponding subfields of image data of corresponding cells on an adjacent previous scanning line and an adjacent next scanning line.

13. The plasma display panel of claim 12, wherein the data conversion circuit converts the subfield succeeding the selected subfield of the image datum of the cell to a result of an AND operation between states of corresponding subfields of corresponding cells in an adjacent previous scanning line and an adjacent next scanning line.

14. The plasma display panel of claim 12, wherein the data conversion circuit converts the subfield succeeding the selected subfield of the image datum of the cell to a result of an OR operation between states of corresponding subfields of corresponding cells in an adjacent previous scanning line and an adjacent next scanning line.

15. The method of claim 5, further comprising, for the first one of scanning lines, setting each one of the subfields succeeding the selected subfield in the frame, based on states of corresponding subfields of corresponding cells in an adjacent next scanning line.

16. The method of claim 15, further comprising, for the last one of scanning lines, setting each one of the subfields succeeding the selected subfield in the frame, based on states of corresponding subfields of corresponding cells in an adjacent previous scanning line.

17. The plasma display panel of claim 12, wherein, for the first one of scanning lines, the data conversion circuit sets each one of the subfields succeeding the selected subfield in the frame, based on states of corresponding subfields of corresponding cells in an adjacent next scanning line.

18. The plasma display panel of claim 17, wherein, for the last one of scanning lines, the data conversion circuit sets each one of the subfields succeeding the selected subfield in the frame, based on states of corresponding subfields of corresponding cells in an adjacent previous scanning line.

* * * * *